United States Patent [19]

Morris et al.

[11] Patent Number: 4,662,481

[45] Date of Patent: May 5, 1987

[54] ELEVATOR SYSTEM

[75] Inventors: Kim E. Morris, Chester Township; Michael F. Bush, Budd Lake, both of N.J.

[73] Assignee: Westinghouse Electric Corp., Pittsburgh, Pa.

[21] Appl. No.: 839,487

[22] Filed: Mar. 14, 1986

[51] Int. Cl.[4] ..... B66B 5/16

[52] U.S. Cl. ..... 187/77; 187/38; 188/189

[58] Field of Search ..... 187/89, 90, 91, 73, 187/77, 78, 38, 86, 85, 88; 188/188, 189, 184; 254/389

[56] References Cited

U.S. PATENT DOCUMENTS 713,706 11/1902 Smith ..... 187/77

3,783,978 1/1974 Hamilton ..... 187/73

*Primary Examiner*—Joseph J. Rolla

*Assistant Examiner*—Kenneth Noland

*Attorney, Agent, or Firm*—D. R. Lackey

[57] ABSTRACT

An elevator system having a car mounted governor which includes a rotatable portion biased against a guide rail, and a fixed portion. The governor is pivoted from an operating position in which the rotatable portion rotates in response to car movement, to an operated position, in response to the locking of the rotatable portion to the fixed portion by predetermined car speed in the down travel direction. Movement of the governor to the operated position actuates a car safety via a suitable link.

9 Claims, 6 Drawing Figures

ELEVATOR SYSTEM

BACKGROUND OF THE INVENTION

1. Field of the Invention

The invention relates in general to elevator systems, and more specifically to elevator systems having a governor for actuating a car safety at a predetermined speed in the down travel direction.

2. Description of the Prior Art

An elevator car suspended by wire ropes must be provided with a safety attached to the car sling or frame, within or below the lower members of the car frame called the safety plank. The safety, when actuated, operates upon the guide rails between which the car frame is located. The car safety is actuated by a separate speed governor which is set to trip at a predetermined car speed in the down travel direction, which predetermined speed is at least 115% of rated speed. While prior art governors have been mounted on the elevator car, it is more conventional for the governor to be mounted in the machine room.

It would be desirable to provide a new and improved car mounted governor, eliminating the need for governor ropes which run the length of the hoistway, which are required for governors mounted in the machine room. It would further be desirable to be able to reset the governor by upward car motion, at the same time the safety is reset. Finally, it would be desirable to provide a new and improved car mounted governor which can actuate a car safety of the type normally operated by a machine room mounted governor, without significant modification of the car safety.

SUMMARY OF THE INVENTION

Briefly, the present invention is a new and improved elevator system having a car mounted governor biased against a guide rail by a dead shaft. The dead shaft and governor are pivotable as a unit between operating and operated positions, with the governor being biased against the guide rail throughout the pivot range. In the operating position, a rotatable cylinder of the governor contacts the guide rail and rotates in response to movement of the governor past the guide rail. In the operated position, the rotatable cylinder is locked to a fixed cylinder at a predetermined car speed in the down travel direction. The locking of the rotatable cylinder initiates pivoting of the governor and dead shaft to the operated position, due to friction between the now stationary rotatable cylinder and the guide rail. The vertically upward movement of the governor along the guide rail at the overspeed setting actuates a car safety in a manner similar to actuating a car safety with a governor rope.

BRIEF DESCRIPTION OF THE DRAWINGS

The invention may be better understood, and further advantages and uses thereof more readily apparent, when considered in view of the following detail description of exemplary embodiments, taken with the accompanying drawings in which.

DESCRIPTION OF PREFERRED EMBODIMENTS

Figure 2:
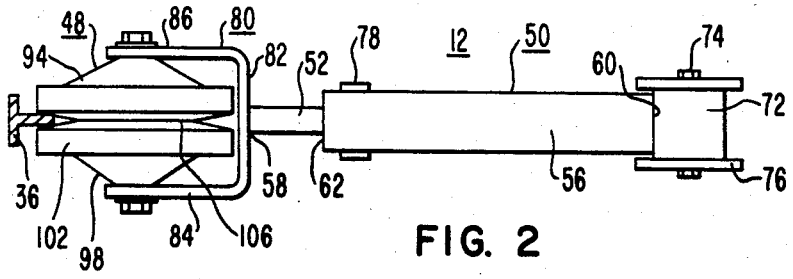
FIG. 2 is a plan view of the car mounted governor shown in FIG. 1.
Figure 1:
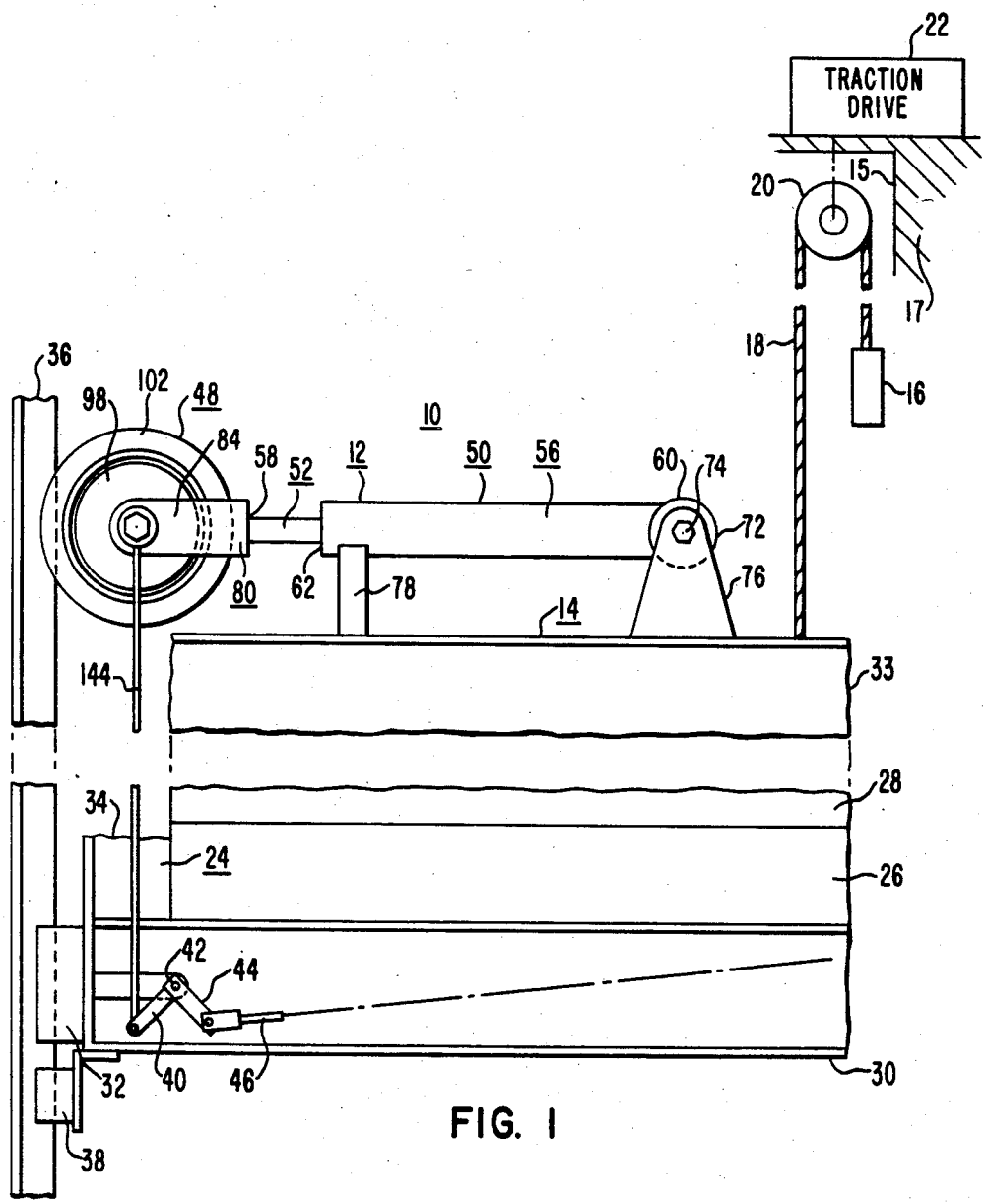
FIG. 1 is an elevational view of an elevator system having a car mounted governor constructed according to the teachings of the invention.

Referring now to the drawings, and to FIGS. 1 and 2 in particular, there is shown an elevator system 10 having a car mounted governor 12 constructed according to the teachings of the invention. FIG. 1 is an elevational view of elevator system 10, with nonessential parts not shown, and FIG. 2 is a plan view of the car mounted governor 12. Elevator system 10 is illustrated as being of the traction type, but the car mounted governor may be used with any type of elevator car guided by guide rails.

More specifically, elevator system 10 includes an elevator car 14 mounted in a hoistway 15 of a building 17, with car 14 being interconnected with a counterweight 16 via a plurality of wire ropes shown generally at 18. Since elevator car 14 is symmetrical on either side of ropes 18, the right-hand side of the elevator car is not shown in FIG. 1 in order to simplify the drawings. Ropes 18 are reeved about a traction drive sheave 20, and drive sheave 20 is driven by a traction drive machine 22.

Elevator car 14 includes a car sling or frame 24, which supports a platform 26 and a cab 28. Sling 24 includes a safety plank 30 which includes a safety 32, stiles which rise upwardly from the ends of the safety plank 26, such as stile 32, and a top beam or crosshead 33 across the top of elevator car 14. Governor 12 is mounted on the top of car 14, to the crosshead 33, or other structural member having the requisite strength. Car 14 is guided in its vertical travel path by a pair of spaced guide rails in the hatch or hoistway 15, such as guide rail 36, and by a plurality of guide rollers mounted on the elevator car 14 which coact with the guide rails, such as guide rollers 38. U.S. Pat. No. 3,768,597 describes a car safety which may be actuated by governor 12. Clockwise rotation of lever 40 on safety 32 rotates shaft 42 to actuate the left-hand clamp safety, and rotation of shaft 42 also rotates lever arm 44 which actuates the right-hand clamp safety (not shown) via a tie rod 46.

Figure 3:
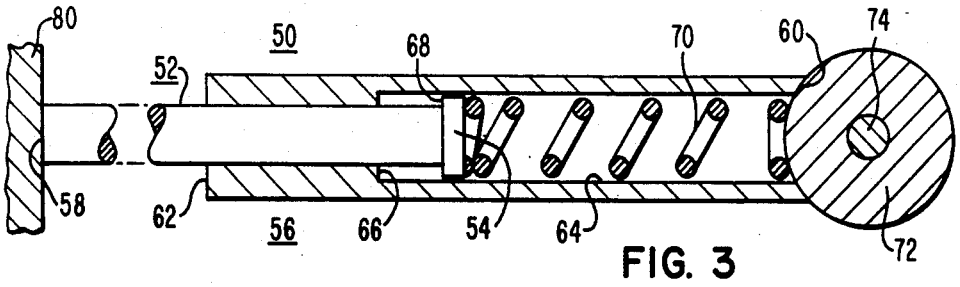
FIG. 3 is a cross-sectional view of a biased dead shaft shown in FIGS. 1 and 2, which biases the car mounted governor against the guide rail in both the operating and the operated positions of the governor and dead shaft.

Governor 12 includes first and second basic portions 48 and 50, respectively, with the second portion 50 biasing the first portion 48 against a guide rail, such as guide rail 36. The second portion 50 includes a spring loaded metallic dead shaft 52, best shown in FIG. 3, which is a cross-sectional view of the second portion 50. Dead shaft 52 has a first end 54 disposed within a hollow, metallic, tubular member 56, and a second end 58 disposed outside of tubular member 56. Tubular member 56 has first and second ends 60 and 62, respectively, and an opening or cavity 64 which extends between its ends. Opening 64 starts at end 60 with a first predetermined diameter, and then it steps inwardly to a smaller diameter before reaching end 62, to define a shoulder or stop 66 at the transition point. Shaft 52 is assembled within tubular member 56 by inserting the second end of shaft 52 through the first end 60 of tubular member 56. The first end 54 of shaft 52 includes a shoulder portion 68 which cooperates with stop 66 to limit the travel of shaft 52. A spring 70 is inserted within opening 64 to bias end 54 of shaft 52 towards stop 66. End 60 of tubular member 56 is subsequently closed, such as by welding tubular member 56 to a cylindrical member 72. Cylindrical member 72 has an axial opening for receiving a pivot pin 74.

The second portion 50 of governor 12 is pivotally mounted to a trunnion 76, and trunnion 76 is fixed to the top of elevator car 14, which mounting arrangement may include the crosshead 33 of the car frame or sling 24, or other structural beam of requisite strength. Tubular member 56 is supported near its second end 62 by an upstanding support member 78, with support member 78 forming a first limit or stop for the pivotal movement of the second portion 50 about pivot pin 74. In other words, support 78 provides a limit on the counterclockwise pivotal movement of tubular member 56, but it does not prevent clockwise rotation of tubular member 56.

A bifurcated or U-shaped frame 80 having a bight 82 and outwardly extending arms 84 and 86, completes the second portion 50 of governor 12. Arms 84 and 86 each include an opening adjacent to their outwardly extending ends, such as opening 88 in arm 86. The second end 58 of shaft 52 is welded to bight 82, such that a center line which extends through both of the openings in arms 84 and 86 lies in the same plane as the pivot axis defined by pivot pin 74.

Figure 5:
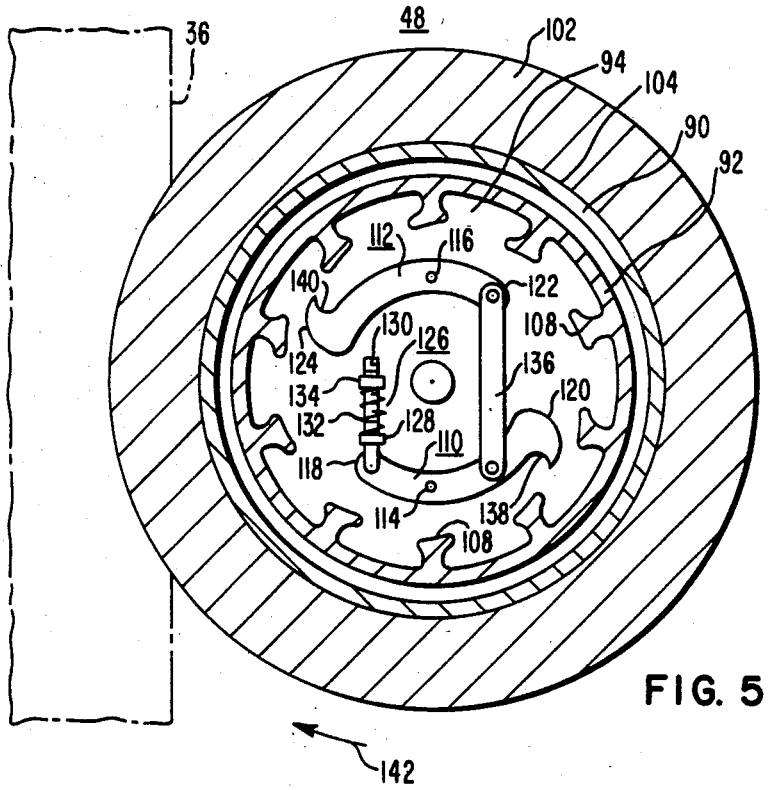
FIG. 5 is a cross-sectional view of the car mounted governor shown in FIGS. 1, 2 and 4.
Figure 4:
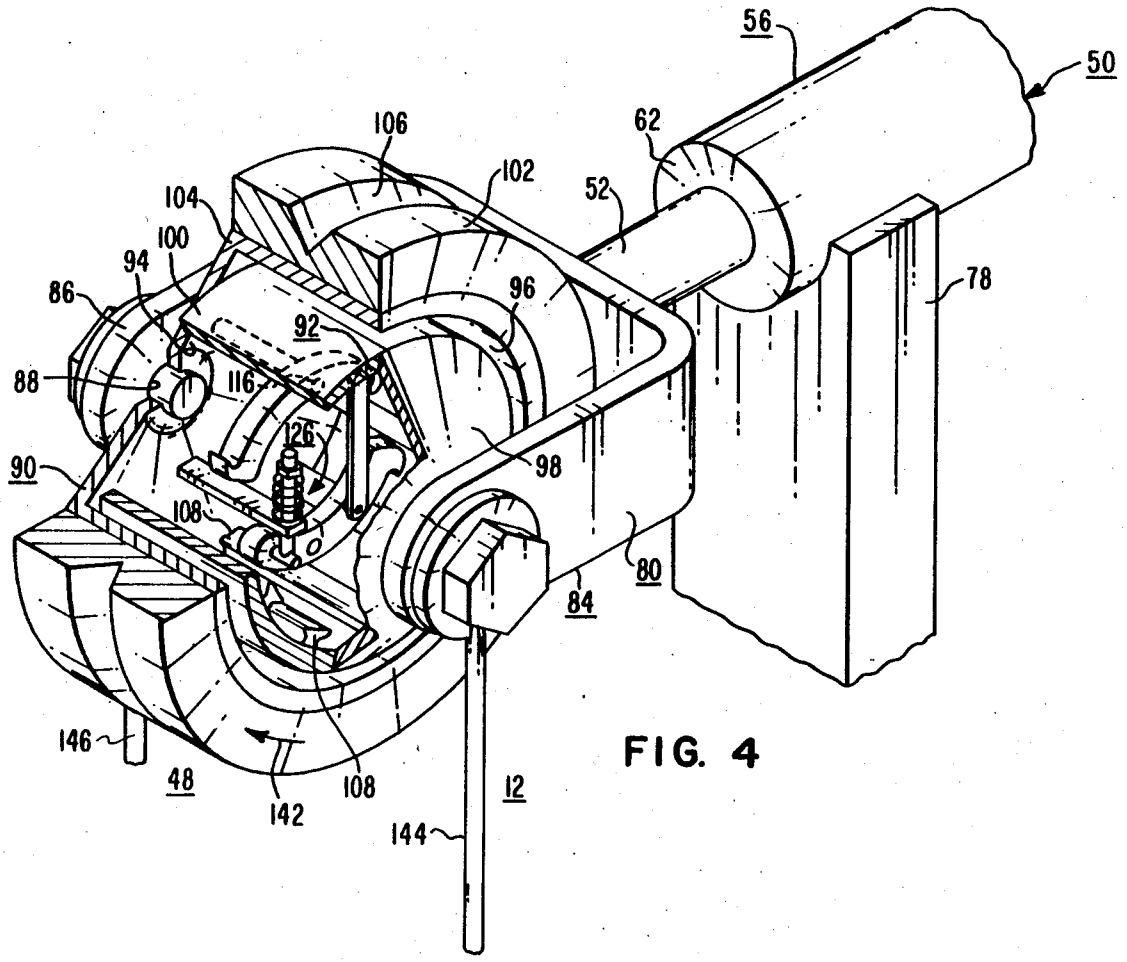
FIG. 4 is a fragmentary, perspective view, with portions cut away, of the car mounted governor and dead shaft shown in FIGS. 1 and 2.

The first portion 48 of governor 12 includes rotatable and fixed, concentric, nested cylinders 90 and 92, respectively, as best shown in FIGS. 4 and 5. FIG. 4 is a perspective view of governor 12, with parts of the first portion 48 cut away. FIG. 5 is a cross-sectional view of the first portion 48 of governor 12. Rotatable cylinder 90 has a closed end 94 and an open end 96. Fixed cylinder 92 has a closed end 98 and an open end 100. The rotatable and fixed cylinders 90 and 92, respectively, are coaxially assembled with their open ends 96 and 100 facing one another. The fixed cylinder 92 is fixed to arm 84 of support frame 80. The rotatable cylinder 90 is journaled for rotation, utilizing a suitable bearing (not shown) disposed in opening 88 of arm 86 of support frame 80.

A resilient elastomeric tire 102, such as a tire formed of polyurethane, is bonded or otherwise suitably fixed to the outer surface 104 of the rotatable cylinder 90. Tire 102 includes a peripheral groove 106 shaped to snugly receive the stem portion of guide rail 36.

The inner surface of fixed cylinder 92 has a plurality of circumferentially spaced ratchet teeth 108 which extend radially inward. Thus, the fixed cylinder 92 functions as a ratchet wheel.

A pair of dog-legs or centrifugal weights 110 and 112 are pivotally mounted to the closed end 94 of the rotatable cylinder 90, such as via pivot pins 114 and 116, respectively. Weight 110 includes first and second ends 118 and 120, respectively, and weight 112 includes first and second ends 122 and 124, respectively. End 118 of weight 110 is biased counterclockwise, as viewed in FIG. 5, by a spring biasing arrangement 126. Biasing arrangement 126 includes an upstanding support member 128 fixed to closed end 94 of rotatable cylinder 90, a shaft 130 disposed through an opening in support member 128, with one end of shaft 130 being fixed to end 118 of centrifugal weight 110, a spring 132 telescoped over shaft 130, and a nut 134 which secures spring 132 on shaft 130, and adjusts the bias. The bias is adjusted to select the car speed at which the weights 110 and 112 will move outwardly against the bias to a point which causes the rotatable cylinder 90 to engage the fixed cylinder 92. The bias provided by bias arrangement 126 is translated from weight 110 to weight 112 via a linkage member 136 which is pivotally fixed to both weights 110 and 112.

Figure 6:
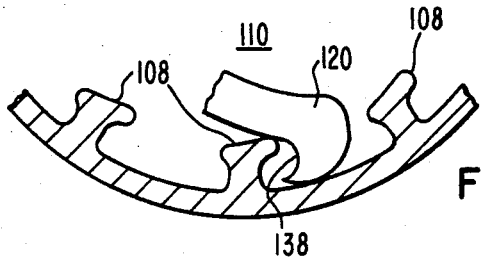
FIG. 6 is a fragmentary view illustrating engagement between a hook end of a centrifugal weight mounted on a rotatable cylinder, with the teeth of a ratchet wheel disposed about the internal surface of a fixed cylinder.

Ends 120 and 124 of weights 110 and 112, respectively, have hook ends 138 and 140, respectively, which are oriented to engage teeth 108, as shown in FIG. 6, when rotatable cylinder 90 is rotated in response to downward travel of the elevator car 14. Downward travel by the elevator car 14 imparts a rotary motion to the tire 102 as indicated by arrow 142 in FIG. 5. When car 14 travels upwardly, hooks 138 and 140 cannot engage the ratchet teeth 108.

Governor 12 is linked to car safety 32 via one or two linking members, such as linking members 144 and 146 shown in FIG. 4. Linking members 144 and 146 are connected to arms 84 and 86, respectively, of frame 80, and to the operating levers of safety 32, such as to the operating lever 40 shown in FIG. 1. Linking members 144 and 146 may be rods, or wire rope, as desired.

In the operation of governor 12, the first portion 48 is disposed with the tire portion 102 engaging guide rail 36, with the stem of guide rail 36 being disposed within groove 106 of tire 102. Spring 70 positively seats tire 102 firmly against guide rail 36, and the spring maintains positive traction which causes car movement to be translated to rotation of the first portion 48 of governor 12. In the normal or "operating" position of governor 12, tubular member 56 is resting upon support 78, which, as hereinbefore stated, functions as a first limit or stop for pivotal movement of governor 12 in a vertical plane about pivot pin 74.

Rotatable cylinder 90 rotates at a rotational speed directly responsive to car speed, and, at a predetermined car speed, selected by bias arrangement 126, the dog-leg assembly of weights 110 and 112 moves outwardly by centrifugal force. When the weights 110 and 112 move far enough, they engage ratchet teeth 108, if the elevator car 114 is travelling in the down travel direction, and at this point the rotatable cylinder 90 is fixed to the fixed cylinder 92, halting the rotation of the rotatable cylinder 90 and its associated tire portion 102. Since spring 70 continues to push tire 102 against guide rail 36, sliding friction between the tire portion 102 and guide rail 36 now forces governor 12 to ride upwardly, since tire 102 can no longer roll along the guide rail. In other words, governor 12 starts to pivot clockwise about pin 74, while spring 70 continues to bias tire 102 against guide rail 36. Thus, the first portion 48 of the governor 12 moves vertically upward along the guide rail, and linking members 144 and 146 are pulled vertically upward, actuating the car safety 32. Once the operating mechanism of the car safety 32 has been actuated from the reset to the set position, linking members 144 and 146 hold governor 12 and prevent any further rise of the first portion 48 along the guide rail 36, as well as preventing any further pivoting of the governor 12 about the pivot pin 74. This is the second or "operated" position of governor 12. A car safety operated by a governor in the machine room via a governor rope in the hoistway has considerable system inertia, and a large bias spring is utilized which must be overcome in order to rotate link 40 and shaft 42 of the safety 32. The conventional safety is modified by replacing the large bias spring by a much softer spring, when the safety is to be operated by the car mounted governor 12 of the present invention, as there is almost no system inertia to operate against.

Once the car safety 32 has set, it is generally reset by running the elevator car 14 in the up travel direction. This action of resetting the safety will also automatically reset governor 12 due to the unique shape of the ratchet teeth 108 shown in FIGS. 5 and 6. The overhang of each tooth 108 causes friction in the up travel direction once the governor 12 has been set. This friction drags portion 48 of the governor 12 back down the guide rail, since tire 102 is not free to roll, until tubular member 56 encounters the stop 78. The positive and sudden force of stop 78 against tubular member 56 as the elevator car 14 moves in the upward travel direction is sufficient to pop the hooks 138 and 140 out of the grooves defined by the spaced ratchet teeth 108, to reset the governor 12.

In summary, there has been disclosed a new and improved elevator system having a car mounted governor which operates a car safety. The car mounted governor may be applied to any elevator car, regardless of the type of motive means used for driving the elevator car. The car mounted governor is a very low inertia system, requiring no governor ropes, and eliminating allied items such as the governor sheave and associated idler sheave in the hoistway. The car mounted governor of the present invention is easily adapted to operate car safeties normally operated by a governor rope, merely by changing to a softer bias spring in the safety operating mechanism, because of the very low inertia of the disclosed car mounted governor system. Finally, the governor is self-resetting, as it automatically resets when the elevator car is run in the up travel direction in order to reset the safety.

We claim as our invention:

1. An elevator system, comprising:

an elevator car, means including guide rails for mounting said elevator car for guided vertical movement in the up and down travel directions, a car safety carried by said elevator car, said car safety being actuatable to engage said guide rails and stop said elevator car, a governor carried by said elevator car, said governor having rotatable and fixed concentric, nested cylinders, said rotatable cylinder including a wheel portion adapted to engage a guide rail, biasing means operable between first and second positions, said biasing means biasing the wheel portion of said rotatable cylinder against a guide rail in both of said first and second positions, said biasing means normally being in said first position, in which said rotatable cylinder rotates with car movement, cooperable means on said rotatable and fixed cylinders for locking the rotatable cylinder and its associated wheel portion to the fixed cylinder at a predetermined car speed in the down travel direction, whereby friction between the wheel portion, when locked, and the associated guide rail, operates said biasing means to said second position, and means responsive to movement of said biasing means to said second position for actuating said car safety.

2. The elevator system of claim 1 wherein the biasing means has first and second ends, and including means pivotally fixing said first end to the elevator car, and with the second end supporting the rotatable and fixed cylinders, wherein the biasing means pivots from the first to the second positions when the rotatable and fixed cylinders are locked.

3. The elevator system of claim 1 wherein the rotatable and fixed cylinders are hollow cylinders each having a closed end, and wherein the cooperable means includes centrifugal means on the closed end of the rotatable cylinder and ratchet teeth on the fixed cylinder.

4. The elevator system of claim 1 including stop means, with the biasing means contacting said stop means when in the first position, and wherein car movement in the up travel direction when the biasing means is in the second position operates said biasing means from the second position to the first position against said stop means due to friction between the locked wheel portion and associated guide rail, with the stop means providing a force which actuates the cooperable means to unlock the rotatable and fixed cylinders.

5. The elevator system of claim 1 wherein the cooperable means includes centrifugal means on the rotatable cylinder and ratchet teeth on the fixed cylinder, with the centrifugal means including hooks for engaging said ratchet teeth at the predetermined car speed in the down travel direction.

6. The elevator system of claim 5 including stop means, with the biasing means contacting said stop means when in the first position, and wherein the biasing means is spaced from said stop means in the second position, and wherein car movement in the up travel direction when the biasing means is in the second position operates said biasing means from the second position to the first position against said stop means, due to friction between the locked wheel portion and associated guide rail, with the stop means providing a force which promotes disengagement of the hooks from the ratchet teeth, to reset the governor.

7. The elevator system of claim 1 wherein the biasing means includes a spring loaded dead shaft having one end pivotally fixed to the elevator car and a bifurcated frame at the other end for supporting the rotatable and fixed cylinders.

8. The elevator system of claim 7 wherein the rotatable and fixed cylinders are hollow cylinders each having a closed end, with the bifurcated frame having a first arm which fixedly supports the closed end of the fixed cylinder, and a second arm which rotatably supports the closed end of the rotatable cylinder.

9. An elevator system, comprising:

an elevator car, means including guide rails for mounting said elevator car for guided vertical movement in the up and down travel directions, motive means for said elevator car, a car safety carried by said elevator car, said car safety being actuatable to engage said guide rails and stop said elevator car, a governor carried by said elevator car, said governor having rotatable and fixed concentric, hollow, nested cylinders, each having a closed end, said rotatable cylinder including a wheel portion which frictionally engages a guide rail, said fixed cylinder having ratchet teeth, biasing means pivotable between operating and operated positions, said biasing means biasing the wheel portion of said rotatable cylinder against a guide rail, in both said operating and operated positions, with said biasing means normally being in said operating position in which the rotatable cylinder rotates with car movement, centrifugal means carried by said rotatable cylinder for engaging ratchet teeth of said fixed cylinder and locking the rotatable cylinder and its associated wheel portion to the fixed cylinder at a predetermined car speed in the down travel direction, whereby friction between the wheel portion, when locked, and the associated guide rail, pivots said biasing means from the operating to the operated positions, and means responsive to movement of said biasing means to the operated position for actuating said car safety.

* * * * *